United States Patent [19]

Kato

[11] 4,433,480

[45] Feb. 28, 1984

[54] METHOD OF INSTALLING CERAMIC FIBER BLOCKS

[75] Inventor: Takeo Kato, Aichi, Japan

[73] Assignee: Isolite Babcock Refractories Co., Ltd., Hoi, Japan

[21] Appl. No.: 293,935

[22] Filed: Aug. 18, 1981

[30] Foreign Application Priority Data

Aug. 19, 1980 [JP] Japan ..... 55-113670

[51] Int. Cl.[3] ..... B23P 11/00

[52] U.S. Cl. ..... 29/432; 29/455 R; 29/526 R; 52/509; 52/511; 126/144

[58] Field of Search ..... 29/432, 455 R, 526 R; 52/747, 509, 511; 126/144

[56] References Cited

U.S. PATENT DOCUMENTS

| | | | |
|---|---|---|---|
| 1,052,670 | 2/1913 | Francis | 52/509 |
| 2,281,519 | 4/1942 | Faber | 52/509 X |
| 2,319,129 | 5/1943 | Hamilton | 52/509 X |
| 2,433,175 | 12/1947 | Urmetz | 52/509 X |
| 3,376,681 | 4/1968 | Demaison | 52/511 X |
| 3,579,802 | 5/1971 | Gajovski | 29/455 R X |
| 3,909,907 | 10/1975 | Davis | 29/526 R X |
| 3,936,927 | 2/1976 | Schneider | 29/432 X |
| 4,291,514 | 9/1981 | Harvey | 52/509 |

*Primary Examiner*—Charlie T. Moon
*Attorney, Agent, or Firm*—A. W. Breiner

[57] ABSTRACT

Each ceramic fiber block is temporarily supported by a supporting member and bar combination previously secured to the furnace casing, before it is finally secured to the casing by another supporting member and bar combination. No separate means for holding the block temporarily is required. As ceramic fiber blocks and supporting members are alternately attached to the casing, it is possible to ensure intimate contact between every two adjoining blocks. The absence of any extra work for holding the blocks temporarily improves the efficiency of the block installation work.

4 Claims, 3 Drawing Figures

METHOD OF INSTALLING CERAMIC FIBER BLOCKS

BACKGROUND OF THE INVENTION

1. Field of the Invention

This invention relates to a method of securing insulating ceramic fiber blocks to a furnace casing.

2. Description of the Prior Art

When supporting members are used to secure a set of ceramic fiber blocks to a furnace casing, it has been usual to attach all of the supporting members to the casing beforehand, or attach them one after another after the blocks have been positioned one by one on the casing. According to the former method, however, it is difficult to adjust the position of one block relative to another to bring them into intimate contact with each other, since the supporting members are attached to the casing beforehand. Although the latter method facilitates such positional adjustment of the blocks, it is a very cumbersome job to hold each block in position relative to the casing until the corresponding supporting member is secured to the casing.

SUMMARY OF THE INVENTION

It is an object of this invention to provide a method of installing ceramic fiber blocks which overcomes the problems hereinabove pointed out.

The method of this invention consists essentially in holding a ceramic fiber block temporarily on a supporting member attached to a casing beforehand, and attaching another supporting member to the casing to secure the block thereto.

Further objects, advantages and features of the present invention will become more fully apparent from a detailed consideration of the arrangement and construction of the constituent parts as set forth in the following specification taken together with the accompanying drawing.

DETAILED DESCRIPTION OF PREFERRED EMBODIMENTS

Figure 1:
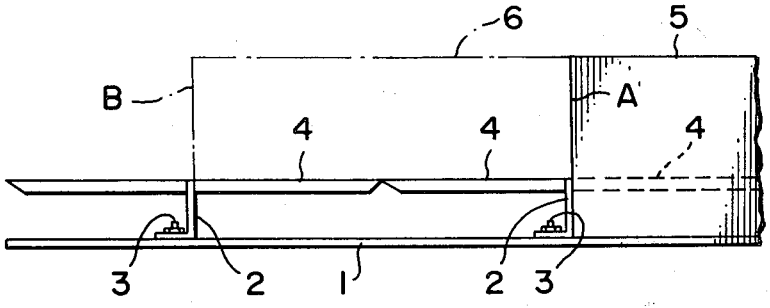
FIG. 1 illustrates the way in which the method of this invention may be carried out and is a view in which a furnace casing is shown in top plan.
Figure 2:
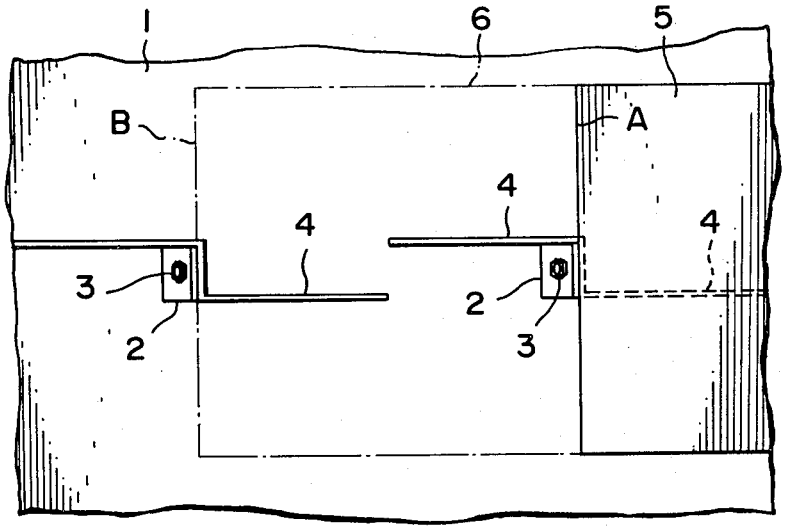
FIG. 2 is a view taken from the interior of the furnace.
Figure 3:
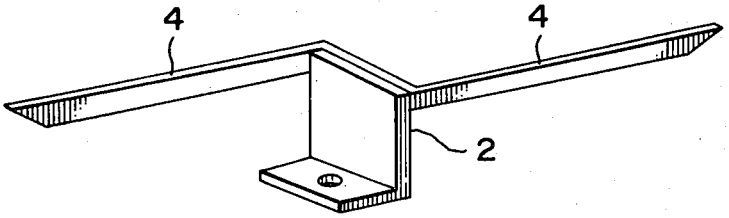
FIG. 3 is a perspective view of one of the supporting members and bars employed in the method of this invention shown by way of example in FIGS. 1 and 2.

Referring to the drawing, there is shown a steel plate furnace casing 1 to which a supporting member 2 is attached by a stud bolt 3 as shown on the right-hand side of FIG. 1 or 2. The supporting member 2 comprises a rectangular piece of heat resistant steel bent at a right angle, and having an L-shaped cross section as shown in FIG. 3. One leg of the L-shaped member has a hole through which the bolt 3 may be passed to secure the member to the casing 1. The other leg of the supporting member 2 carries thereon a supporting bar 4 having a middle portion secured to the member 2 by spot welding, or otherwise. The supporting bar 4 comprises a slender flat bar of heat resistant steel having a middle portion secured to the other leg of the supporting member 2, and a pair of parallel, laterally spaced apart portions bent at right angles, and projecting in opposite directions from the middle portion thereof. The supporting bar 4 has a pair of pointed ends. The oppositely projecting portions of the supporting bar 4 are spaced apart from the one leg of the supporting member 2, so that the supporting bar 4 may be positioned in parallel, but spaced apart relationship to the casing 1 when the supporting member 2 is attached to the casing 1.

The supporting member 2 secures a ceramic fiber block 5 to the casing 1. The block 5 has been secured to the casing 1 in such a way that, while the one leg of the supporting member 2 is maintained in contact with the casing 1, the supporting bar 4 is pierced through the block 5 as shown by broken lines until the supporting member 2 intimately contacts the block 5, and the supporting member 2 is attached to the casing 1.

The broken lines show one of the projecting portions of the supporting bar 4. The other projecting portion of the supporting bar 4 is shown by a solid line, and extends in the opposite direction from the supporting member 2 in spaced apart and parallel relationship to the casing 1. This projecting portion has a length which is a half of the length of another ceramic fiber block 6 still to be secured to the casing 1. FIGS. 1 and 2 also show on the left-hand side thereof another supporting member 2 and another supporting bar 4 that will be used for securing the block 6 to the casing 1.

The block 6 is secured to the casing 1 in a way which will hereunder be set forth. The block 6 is positioned in contact with the casing 1, and its one end surface A is pierced with the supporting bar 4 secured to the casing 1. The block 6 is advanced until its one end surface A reaches the supporting member 2, and intimately contacts the block 5 already secured to the casing 1. The block 6 is, thus, held temporarily in position by the supporting bar 4. The supporting member 2 and the supporting bar 4 on the right-hand side of FIG. 1 or 2 are covered by the ceramic fiber blocks 5 and 6, and isolated from the interior space of the furnace.

Then, the supporting bar 4 shown on the left-hand side of FIG. 1 or 2 is pierced through the opposite end surface B of the block 6, while the supporting member 2 is maintained in sliding contact with the casing 1. The supporting bar 4 is inserted into the block 6 until the supporting member 2 contacts the opposite end surface B of the block 6. Then, the supporting member 2 is secured to the casing 1 by a bolt 3. The bolt 3 reaches the casing 1 through a hole in the supporting member 2, and is welded thereto in situ by a stud welding machine. A nut is placed about the free end of the bolt 3, whereupon the installation of the block 6 is finished. The foregoing procedures are repeated for installing all the blocks as required for lining the furnace.

According to the method of this invention, each ceramic fiber block is temporarily supported by a supporting member and bar combination previously secured to the casing, before it is finally secured to the casing by another supporting member and bar combination. No separate means is required for holding the block temporarily. As ceramic fiber blocks and supporting members are alternately attached to the casing, it is possible to ensure intimate contact between every two adjoining blocks. The absence of any extra work for holding the blocks temporarily improves the efficiency of the block installation work. According to this invention, the supporting members are attached to the casing after the supporting bars have been connected to the blocks.

Since the supporting members are secured to the supporting bars, the ceramic fiber blocks serve to hold the supporting members temporarily. This feature facilitates the attachment of the supporting members to the casing.

It has hereinbefore been stated that each supporting bar has a projecting length which is a half of the block length. This projecting length can, however, be increased to some extent, if it is sufficiently short to ensure proper installation of any adjacent supporting member without interfering with it, irespective of any variation in the block length.

While the present invention has been described with reference to particular embodiments thereof, it will be understood that numerous modifications may be made by those skilled in the art without actually departing from the spirit and scope of the invention as defined in the appended claims.

I claim:

1. A method of installing ceramic fiber blocks on a furnace casing, which comprises providing support members each having an L-shaped cross-section, one leg of said L-shaped member having a hole therein for receiving a fastener for securing said support member to said casing, the other leg of said L-shaped member carrying two supporting bars extending in opposite directions; attaching a first supporting member to said casing by securing said one leg thereof to said casing; piercing one end surface of a ceramic fiber block with one of said supporting bars extending from said supporting member in a cantilevered pattern in spaced apart relationship to said casing; inserting said supporting bar into said ceramic fiber block until said one end surface thereof reaches said supporting member, whereby said block is temporarily supported on said casing; piercing the opposite end surface of said block from said one end surface with a supporting bar projecting from a second supporting member in a cantilevered pattern which is not attached to said casing; inserting said supporting bar of said second supporting member into said block to bring said second supporting member into contact with said opposite end surface of said block in a properly adjusted position; and then attaching said second supporting member to said casing by using a fastener inserted through said hole in said one leg of said support member, whereby said block is secured to said casing.

2. The method of installing ceramic fiber blocks as set forth in claim 1, wherein said supporting bar has a length which is less than that of said ceramic fiber block.

3. The method of installing ceramic fiber blocks as set forth in claim 1, wherein said supporting bars are parallel to each other and parallel to said furnace casing.

4. The method of installing ceramic fiber blocks as set forth in claim 1, wherein each of said supporting bars are parallel and laterally spaced apart.

* * * * *